US005690351A

United States Patent [19]

Karol

[11] Patent Number: 5,690,351

[45] Date of Patent: Nov. 25, 1997

[54] SNOWBOARD BINDING SYSTEM

[76] Inventor: Chris Karol, P.O. Box 6144, Vail, Colo. 81658

[21] Appl. No.: 505,578

[22] Filed: Jul. 21, 1995

[51] Int. Cl.[6] ..... A63C 9/08

[52] U.S. Cl. ..... 280/618; 280/624; 280/14.2

[58] Field of Search ..... 280/607, 617, 280/618, 624, 625, 636, 14.2

[56] References Cited

U.S. PATENT DOCUMENTS

| | | | |
|---|---|---|---|
| Re. 33,544 | 2/1991 | Dennis | 280/618 |
| 3,271,040 | 9/1966 | Spademan | 280/11.35 |
| 3,606,370 | 9/1971 | Spademan | 280/11.35 |
| 3,771,806 | 11/1973 | Hinterholzer et al. | 280/11.35 |
| 3,779,570 | 12/1973 | Betschart, Jr. | 280/11.35 |
| 3,785,668 | 1/1974 | Marker | 280/11.35 |
| 3,838,866 | 10/1974 | D'Alessio et al. | 280/11.35 |
| 3,900,204 | 8/1975 | Weber | 280/11.13 |
| 3,905,613 | 9/1975 | Romeo | 280/11.35 |
| 3,936,062 | 2/1976 | Schweizer | 280/11.35 |
| 3,944,240 | 3/1976 | Bodendorfer | 280/624 X |
| 4,036,510 | 7/1977 | D'Alessio et al. | 280/613 |
| 4,042,257 | 8/1977 | Salomon | 280/624 |
| 4,160,556 | 7/1979 | Gertsch | 280/11.13 |
| 4,182,525 | 1/1980 | Spademan | 280/624 |
| 4,352,508 | 10/1982 | Spademan | 280/624 |
| 4,353,574 | 10/1982 | Faulin | 280/613 |
| 4,741,550 | 5/1988 | Dennis | 280/618 |
| 4,856,808 | 8/1989 | Longoni | 280/617 |
| 4,973,073 | 11/1990 | Raines et al. | 280/624 |
| 4,979,760 | 12/1990 | Derrah | 280/607 |
| 5,028,068 | 7/1991 | Donovan | 280/618 |
| 5,035,443 | 7/1991 | Kincheloe | 280/618 |
| 5,044,656 | 9/1991 | Peyre | 280/618 |
| 5,054,807 | 10/1991 | Fauvet | 280/607 |
| 5,069,463 | 12/1991 | Baud et al. | 280/14.2 |
| 5,085,455 | 2/1992 | Bogner et al. | 280/618 |
| 5,094,470 | 3/1992 | Riedel | 280/607 |
| 5,143,396 | 9/1992 | Shaanan et al. | 280/607 |
| 5,188,386 | 2/1993 | Schweizer | 280/607 |
| 5,299,823 | 4/1994 | Glaser | 280/625 |
| 5,344,179 | 9/1994 | Fritschi et al. | 280/618 |
| 5,354,088 | 10/1994 | Vetter et al. | 280/618 |
| 5,356,170 | 10/1994 | Carpenter et al. | 280/618 |
| 5,401,041 | 3/1995 | Jespersen | 280/14.2 |
| 5,520,406 | 5/1996 | Anderson et al. | 280/633 X |
| 5,558,355 | 9/1996 | Henry | 280/624 |

FOREIGN PATENT DOCUMENTS

| | | |
|---|---|---|
| 0 105 011 | 9/1982 | European Pat. Off. . |
| 2 643 277 | 2/1989 | France . |

OTHER PUBLICATIONS

Transworld Snowboarding Business, vol. 6, No. 5, Mar., 1995.

*Primary Examiner*—Brian L. Johnson
*Assistant Examiner*—Michael Mar
*Attorney, Agent, or Firm*—Sheridan Ross P.C.

[57] ABSTRACT

A snowboard binding system comprising at least one moveable engaging member that, when engaged, secures a snowboarder's boot from vertical or horizontal movement. In one embodiment, a binding system has two active sides allowing a snowboarder to engage the binding by stepping downwardly onto the binding mechanism, thus reversibly forcing tensioned engaging members between an extended and a retracted position and back to an extended position, thereby securing the snowboarder's boot to the upper surface of a snowboard. Other embodiments include snowboard boots having active binding mechanisms positioned on the boot itself, such mechanisms engageable with static members secured to the surface of a snowboard. A further embodiment includes a snowboard boot having a pivotable calf support member and a pivotable, reversibly mounted high-back element.

19 Claims, 16 Drawing Sheets

SNOWBOARD BINDING SYSTEM

FIELD OF THE INVENTION

The present invention is directed to a snowboard binding system, and more particularly to a side engaging binding having at least one moveable engaging member that secures a snowboarder's boot from moving in a vertical or horizontal position once engaged.

BACKGROUND OF THE INVENTION

With the ever increasing popularity of the sport of snowboarding, a need exists for a user-friendly binding system that enables a novice snowboarder to readily adopt the sport without having extensive knowledge of boots and bindings and how they interrelate. An effective binding system must enable a snowboarder to quickly and easily engage and disengage his/her boot from a snowboard. A release mechanism is required that is convenient to operate so that a snowboarder can disengage his/her boot while mounting a chairlift or, in the event of a fall, release as necessary on a snowboard run, such as where the snowboarder requires release from the snowboard in deep snow. A snowboard binding system should be relatively lightweight, sturdy, adaptable to different size boots, rugged, capable of working under conditions where snow and ice may accumulate and must be operable by individuals with gloved hands.

Numerous patents have issued disclosing various types of snowboard bindings, such bindings capable of being categorized as being either toe-to-heel bindings, underfoot attachment bindings or side mounted bindings. Existing designs for toe-to-heel bindings fail to provide the side-to-side support desired by snowboarders, especially given the preferred positioning of a snowboarder's feet along a transverse angle from the longitudinal axis of the snowboard. The "board feel" experienced by snowboarders using a side mounted binding is believed to be superior to that experienced using a toe-to-heel binding. By gripping a snowboarder's boot along the lateral edges of a boot sole, rather than from the toe and heel of a boot, a reduction in the mechanical stresses on the snowboarder's anatomy is achieved since the lateral edges of a snowboarder's boot receive a greater amount of mechanical stress than those encountered at the toe and heel.

Several patents have issued relating to side boot-mounted bindings. For example, U.S. Pat. No. 5,035,443 to Kincheloe discloses a binding in which a boot slides into engagement with a socket member that engages a boot plate underneath the boot sole. The necessity of slidably engaging a boot to a binding, however, presents difficulties in situations where a snowboarder is unable to readily move his/her boot in a manner allowing the boot to slide out of engagement.

U.S. Pat. No. 4,973,073 to Raines et al. describes a binding that relies upon a spring-loaded, cam operated latch on one side of a snowboard binding to secure a boot to a snowboard. Specially designed ridges on each side of a boot are gripped by a pair of opposed mating sockets on the surface of the snowboard, one of such sockets having a spring biased hooking lip rotatably mounted via downwardly projecting portions. The rotational motion of the hooking lip latches one of the ridge portions of the boot binding. A snowboarder is required to first insert a first binding ridge into a longitudinal socket defined by a first ridge entrapping member, and once seated in the socket, the snowboard rider angularly lowers the other side of the boot to allow a second binding ridge to slip downward past the rotating hooking lip. Raines et al.'s design thus requires the angular positioning of a snowboarder's boot to engage the binding and relies upon the rotational interaction of a boot ridge with a pivoting hooking lip.

U.S. Pat. No. 5,299,823 to Glaser describes the use of a boot plate engageable by a fixed jaw and an opposite slide jaw assembly. The slide jaw assembly engages edge portions of a boot plate and has three operating modes, adjusted by moving a cammed lever into either an engaging, locking or intermediate position. A rider first engages the fixed jaw side of the binding and then, with the cammed lever in a proper position, angularly engages the slide jaw so as to cause rotation about a center axis of a locking arm. A rotational force is exerted on the locking arm until a final locking position is achieved whereby the slide jaw housing snaps back to a position to engage the boot plate.

U.S. Pat. No. 4,352,508 to Spademan discloses a ski binding in which opposing pivotally mounted lever members are operated by depressing a heel-receiving member with the tip of a ski pole. By stepping into the bindings, the heel member opens a levered clamping mechanism until the ski boot is placed in the skiing position, at which time the clamping members are allowed to move to a closed position under a biased action of the levered clamping members.

Despite these prior designs, however, a need still exists for a relatively inexpensive, rugged and simple binding system that affords the user-friendliness demanded by novice snowboarders, as well as the ease of operation and superlative board-feel desired by experienced snowboarders. There is also a need for a boot that cooperates with a binding system in such a manner as to facilitate the increasingly demanding safety and performance characteristics desired by today's snowboarders.

Conventional snowboard boots have been generally of a soft shell design and snowboarders often utilize insulated boots such as Sorels®. The mechanical stresses encountered by a snowboarder in manipulating a snowboard, however, require certain aspects of a boot to be more rigid to provide support of various desired ankle and leg configurations. There is, therefore, a need for a snowboarding boot that is designed to cooperate with a side-mounted binding in such a way as to afford a snowboarder maximum support for safety reasons, as well as to enhance desired board-feel.

SUMMARY OF THE INVENTION

The present invention is directed to a snowboard binding system that comprises a side engaging boot binding having at least one active side that permits easy step-in engagement by a snowboarder and that facilitates securement of a snowboarder's boot without undesired vertical and horizontal movements. The present invention provides a system whereby vertical pressure by a snowboarder's boot toward the surface of the snowboard moves an engaging member from a first extended position to a second retracted position, and finally back to the first extended position, thereby securing the boot to the boot binding. A lever is operably attached to the engaging member and is moveable between first and second positions which moves the engaging member between extended and retracted positions, thereby providing for easy disengagement of a boot from the binding. The engaging member of the present invention is reversibly moveable in a substantially horizontal direction away from and toward a rider's boot and the tensional force exerted by the engaging member is preferably adjustable.

In one embodiment, the engaging member is received in a receptacle formed in the lateral side of the sole of a boot, such receptacle either being formed as an integral part of the sole or formed in a boot plate that is attachable to a sole. The engaging mechanism of the present invention provides for the securing of a rider's boot so that neither horizontal nor vertical movement of the boot is possible after engagement. Preferably the restriction of both vertical and horizontal movement are achieved by the moveable engaging member, however, static elements can be used to prevent horizontal movement while the engaging member can be solely relied upon to restrict vertical movement of a boot from a snowboard's surface.

The engaging member of the present invention can be formed from one solid piece of material, or can be of a toothed design. The engaging member's housing can be of an open construction to permit the evacuation of undesired snow or ice from the path of the engaging member. More than one tensioned engaging member can be utilized on one side of a boot to facilitate different torsional control of a binding along the lateral length of a rider's boot.

In one particular embodiment of the present invention, two engaging members are utilized on each opposing side of a rider's boot, thereby alleviating any need for angular positioning of a rider's boot into a fixed binding mount.

Another embodiment of the present invention involves a duo-active sided binding system whereby both engaging members are operable by adjusting a single lever positioned on one or the other side of the binding.

A separate aspect of the present invention is directed to a boot designed to operate effectively with a side engaging and/or duo-active side engaging binding system. A pivotable calf support member is operatively attached to a vertically adjustable high-back element. The high-back element is reversibly engageable with a nub on the boot itself, thus allowing the detachment of the high-back element to afford a natural walking motion by a snowboarder when not engaged in snowboarding.

Other aspects and embodiments of the present invention can be further understood by referring to the drawings below as well as to the detailed description of preferred embodiments of the present invention.

DETAILED DESCRIPTION OF THE PREFERRED EMBODIMENT

Figure 1:
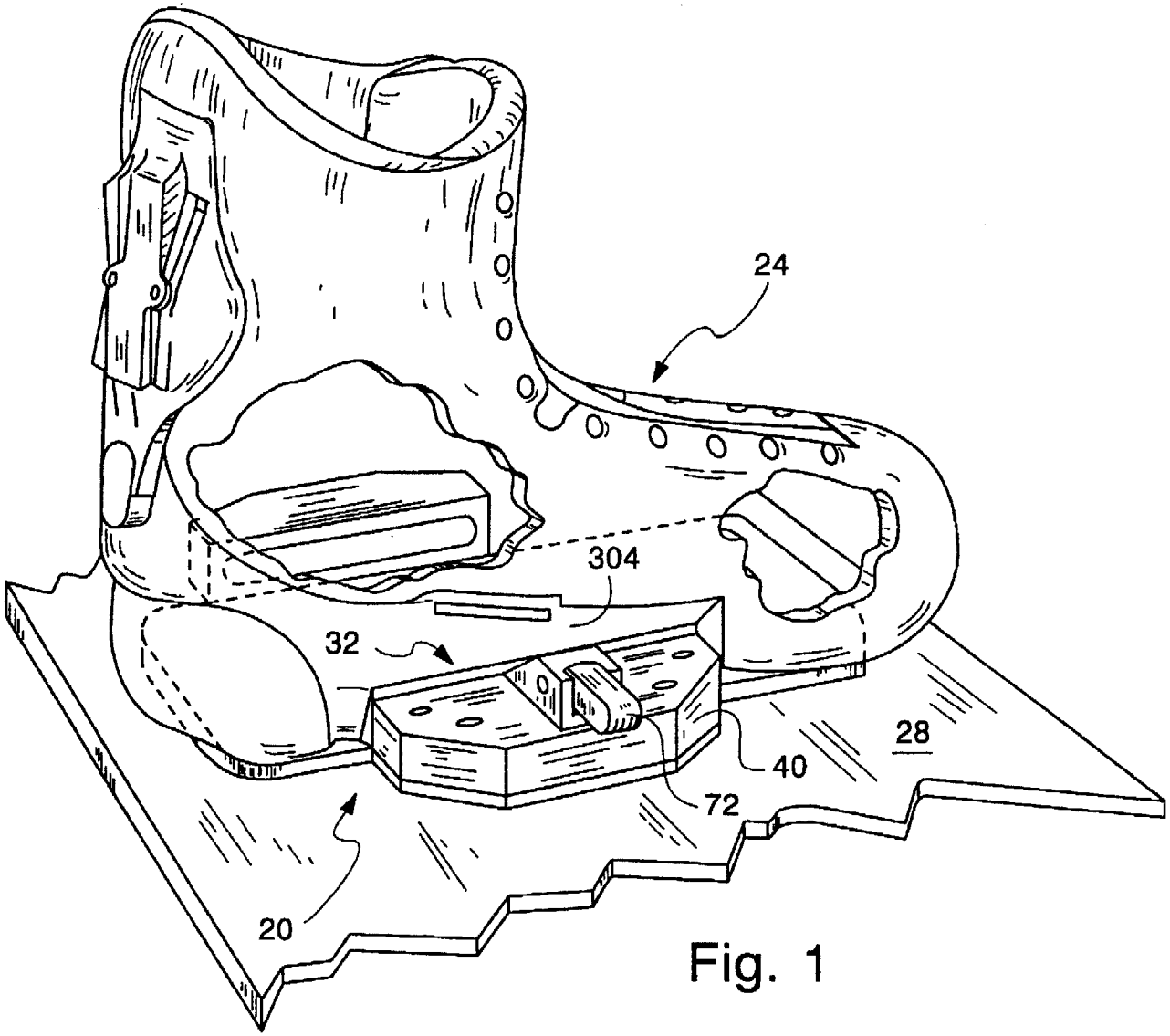
FIG. 1 shows the binding system 20 of the present invention with a boot 24 in an engaged position.
Figure 2:
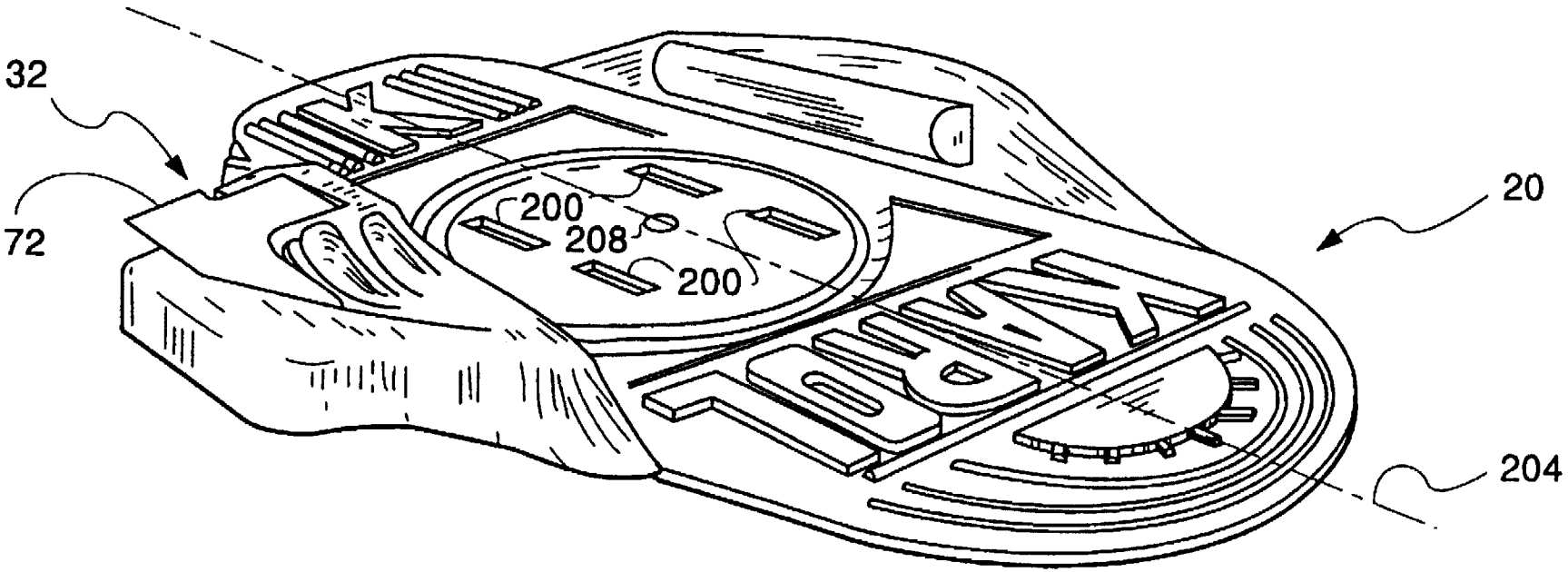
FIG. 2 is a perspective view of a molded embodiment of the present invention showing, for instance, the securing slots 200 where the binding system 20 attaches to a snowboard.
Figure 3A:
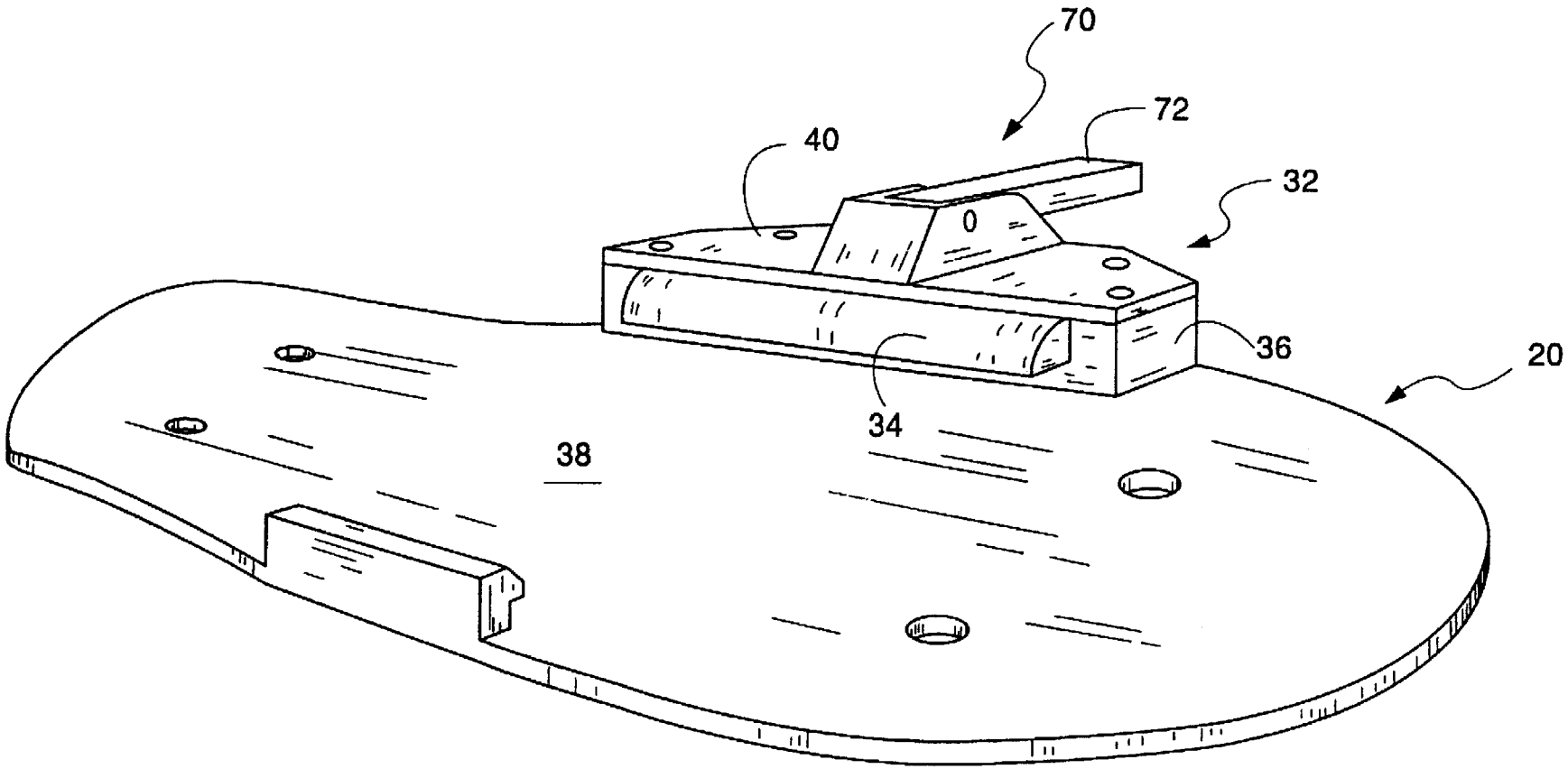
FIG. 3A is another perspective view of the binding system 20 having one active side engaging mechanism 32.
Figure 3B:
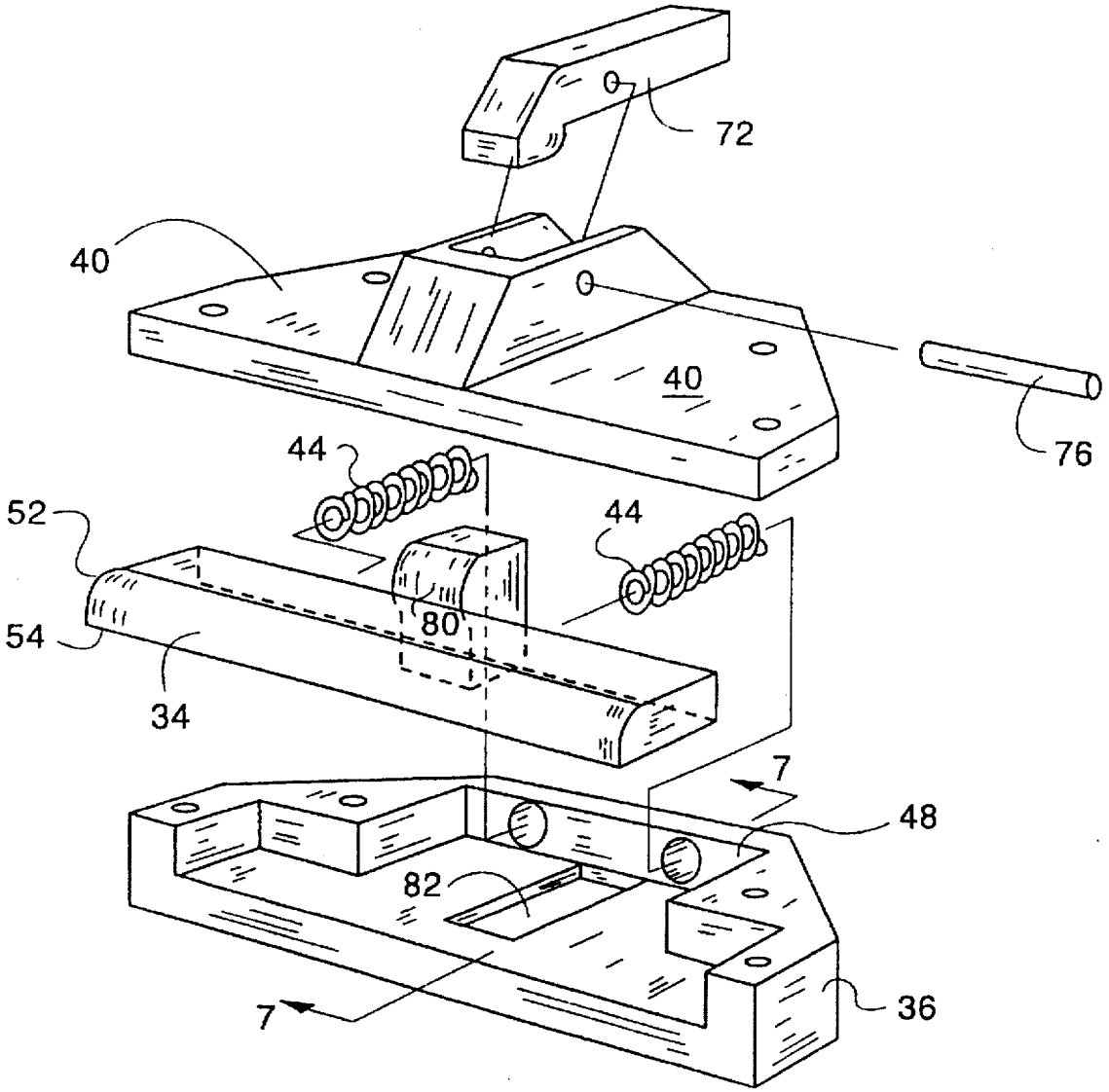
FIG. 3B shows an exploded view of a side engaging mechanism 32.
Figure 4:
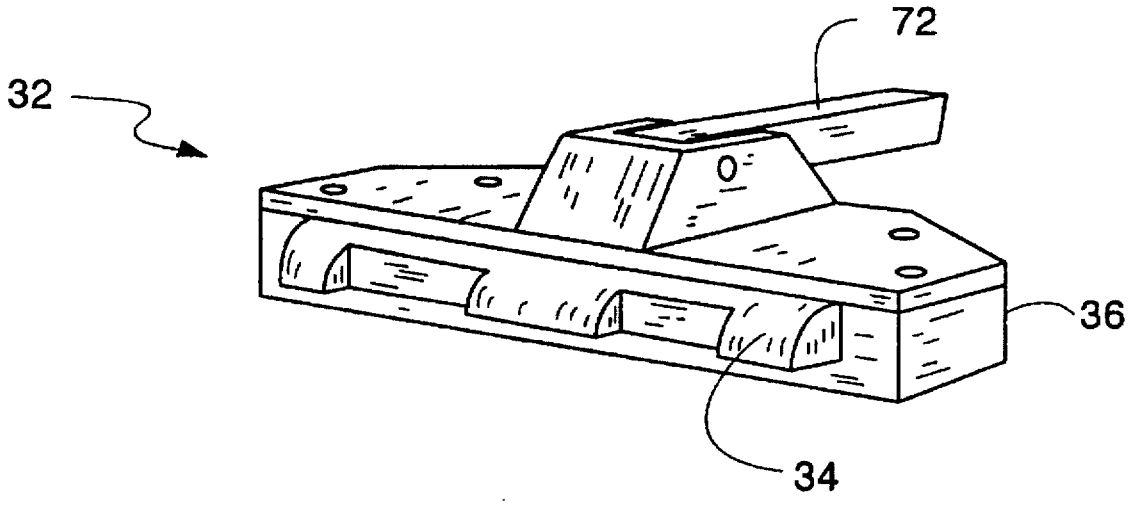
FIG. 4 shows an alternative, "toothed" embodiment of the engaging member 34 of the present invention.

The present invention is, at least in part, directed to a snowboard binding system 20 (e.g., FIG. 1) that allows a snowboarder to step into the binding system and thereby securely lock a snowboard boot 24 to restrain the boot from vertical and horizontal movement in relation to a snowboard 28. In one embodiment of the present invention, the snowboard binding system 20 includes a boot side engaging mechanism 32 (e.g., FIGS. 1, 3A) for binding a snowboard boot 24 to a snowboard 28. As best shown in FIGS. 3A and 3B, the engaging mechanism 32 includes an engaging member 34 housed in an engagement housing 36 and enclosed therein by the housing top 40. Further, the housing 36 is preferably fastened to or integral with a boot positioning plate 38 which is, in turn, fastened to the upper surface of a snowboard 28 in a conventional manner. The engaging member 34 is secured within the housing 36 so as to reversibly move between a first and a second horizontal positions, wherein in said first position the engaging member is extended outward from the housing 36 and said second position the engaging member is retracted into the housing. The engaging member 34 can be of any suitable design. For example, it can be tongue-like (as in FIG. 3A) or, alternatively, toothed-like (as in FIG. 4). The engaging member 34 is placed under tension, for example, by one or more springs 44 (FIG. 3B) biased against an opposing wall 46 of the housing 36, urging said engaging member 34 into said first position. Other suitable tensioning means can be utilized, such as elastic plastic or rubber components that reversibly compress when pressure is applied. In a preferred embodiment, therefore, the engaging member 34 is horizontally moveable, rather than rotationally moveable as in various prior art binding devices. Furthermore, the engaging member 34 is preferably configured so as to have a top surface 52 (e.g., the surface furthest away from the snowboard 28) with a curved or rounded shape. The curved shape facilitates the horizontal movement of the engaging member 34 in a horizontal direction (and thereby into the housing 36) when vertical pressure is applied by the downward force of the sole of a snowboarder's boot 24. In this regard, note that the tension urging the engaging member 34 into the first position is preferably chosen so that the weight applied by a snowboarder is sufficient to move the engaging member from said first position to said second position by merely stepping into the binding system 20. Thus, assuming the sole of the snowboarder's boot 24 is configured with an embodiment of a boot connecting unit for connecting the boot 24 with the binding system 20 by compatibly engaging with the engaging member 34, when the connecting unit contacts the engaging member 34 with sufficient downward force, the engaging member is urged from the first position to the second position. Subsequently, the springs 44 to move back into the first engaging position, thereby locking the connecting unit and the boot 24 into place with respect to the snowboard 28.

Figure 5:
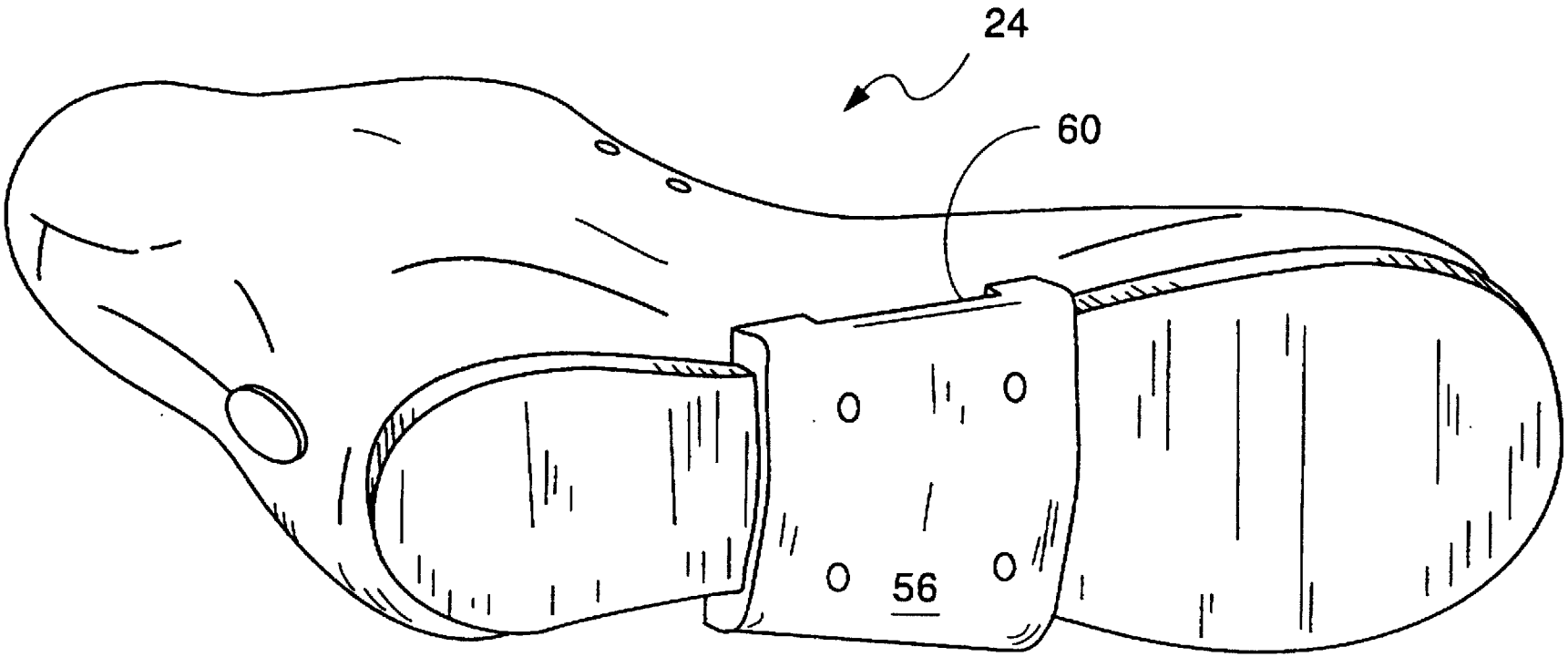
FIG. 5 shows a sole of a boot 24 having a boot plate 56 attached thereto.
Figure 6:
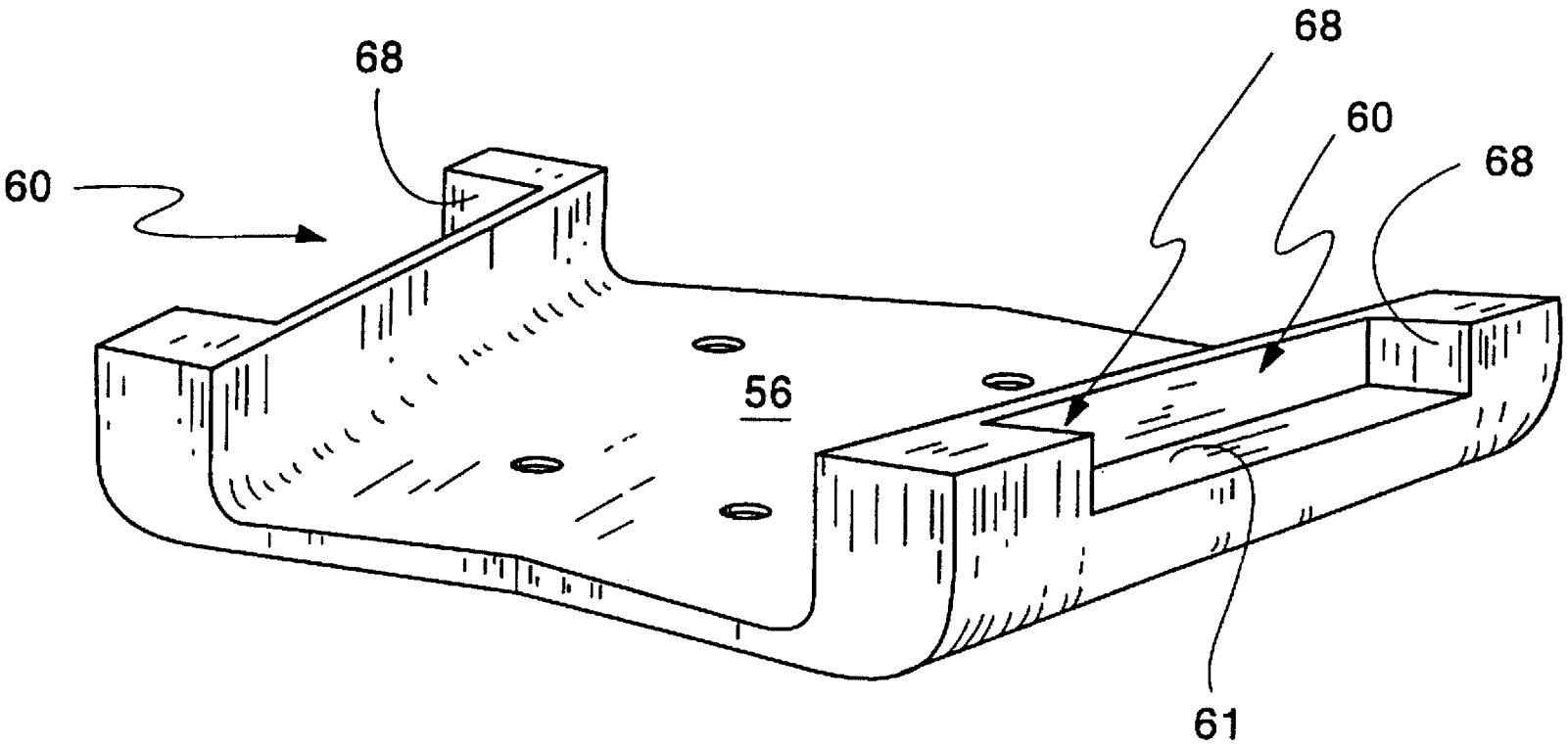
FIG. 6 is a perspective view of the boot plate 56.

Note, in one embodiment, the connecting unit includes a boot plate 56 attached to the sole of the boot (e.g., FIGS. 5 and 6) wherein the boot plate has receptacles 60 formed therein that are capable of receiving the engaging members 34. Thus, in operation, the sole of the snowboarder's boot 24, having for example the boot plate 56, is forced downwardly upon the top curved surface 52 of the engaging member 34, forcing the engaging member into the retracted (second) position within the housing 36. Subsequently, after the boot plate 56 passes over the lower edge 64 of the engaging member 34, the engaging member is free to extend outwardly from the housing into the receptacle 60 formed in the boot plate. The engagement of the engaging member 34 into the receptacle 60 therefore restrains the snowboarder's boot 24 from vertically moving away from the snowboard 28.

Each receptacle 60 can also have opposing side walls 68 that prevent horizontal movement of the snowboarder's boot 24 once the engaging member 34 is within the receptacle. In yet another embodiment, the upper surface of the snowboard 28 may be fitted with static elements, such as boot position braces that preclude horizontal movement of the snowboarder's boot 24, while vertical restraint of the snowboarder's boot is achieved by engagement of the engaging member 34 with the receptacle 60 attached to or integral with the sole of the snowboarder's boot.

Any suitable means can be utilized to accomplish retraction of the reversibly horizontally moveable engaging member 34 when the boot 24 is locked to the binding system 20. In one embodiment, a lever 72 is pivotally connected to the housing 36 via pin 76 (FIG. 3B) for moving the engaging member 34. Although either downward or upward movement of such a lever 72 can be relied upon to retract an engaging member 34, downward movement is not preferred due to the possibility that accidental operation of such a lever is more likely to occur in normal use. Upward lever movement is therefore preferred to cause pivotal rotation of the lever 72 so that the lever presses against a protrusion 80 formed on the engaging member 34. Such pressing causes the protrusion 80 to slide within the horizontal slot 82 (FIG. 3B), thereby assuring that the engaging member 34 retracts without binding or kinking in the housing 36. Thus, the engaging member 34 is forced into a retracted (second) position upon upward pivotable movement of the lever 72. Note that the lever 72 is preferably designed so that a gloved hand can easily operate the lever.

Figure 7:
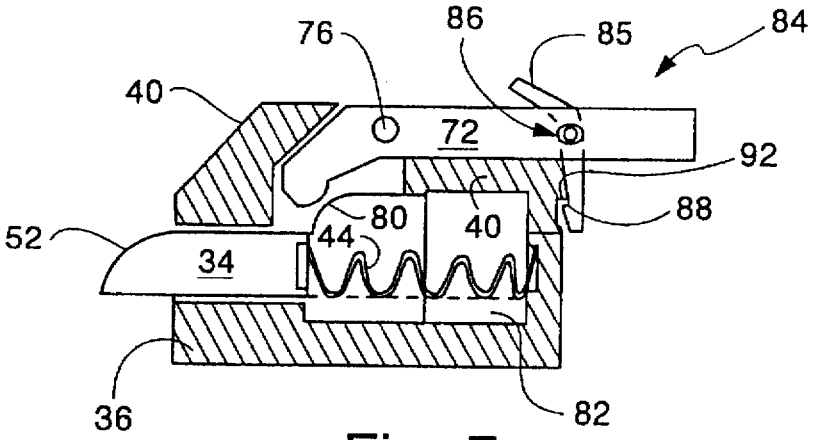
FIG. 7 shows a cross section of the side engaging mechanism 32 obtained by cutting vertically through the side engaging mechanism 32 along the line labeled 7 in FIG. 3B.

To prevent undesired upward movement of the lever 72 during snowboarding, any suitable locking means can be utilized. For example, a "finger-locking" mechanism 84 (FIG. 7) can be used to prevent the lever 72 from moving in a vertically upward motion due to: (a) a retaining contact 88 of a finger lock 84 with a top surface 92 of the engagement housing top 40, and (b) a circular spring 86 that biases the finger locking mechanism 84 in a clockwise direction.

Figure 8:
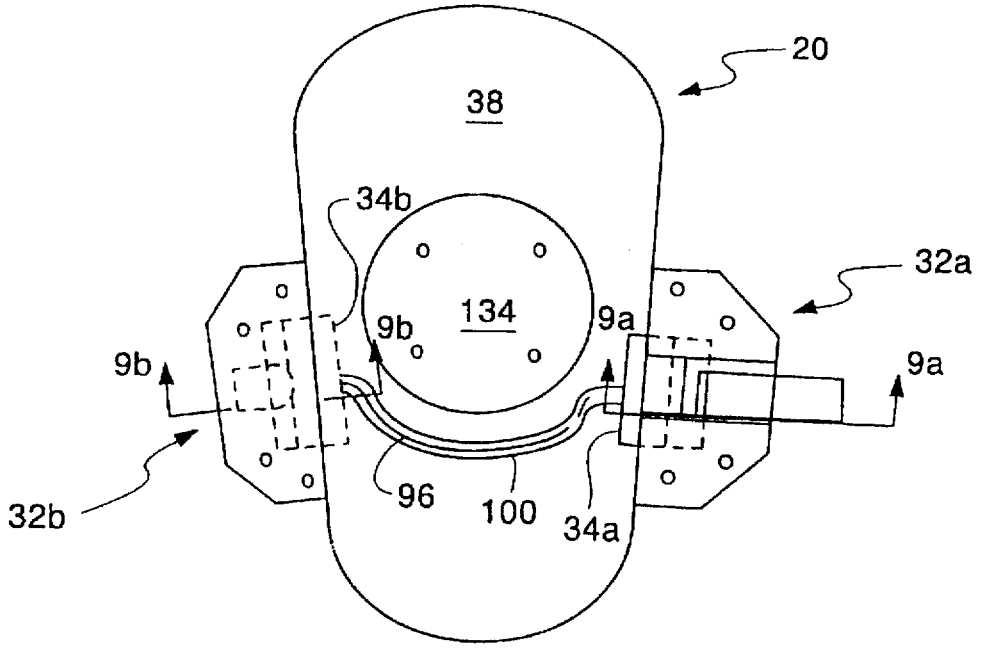
FIG. 8 is a top view of the binding system 20, wherein there are two opposed side engaging mechanisms.
Figure 9:
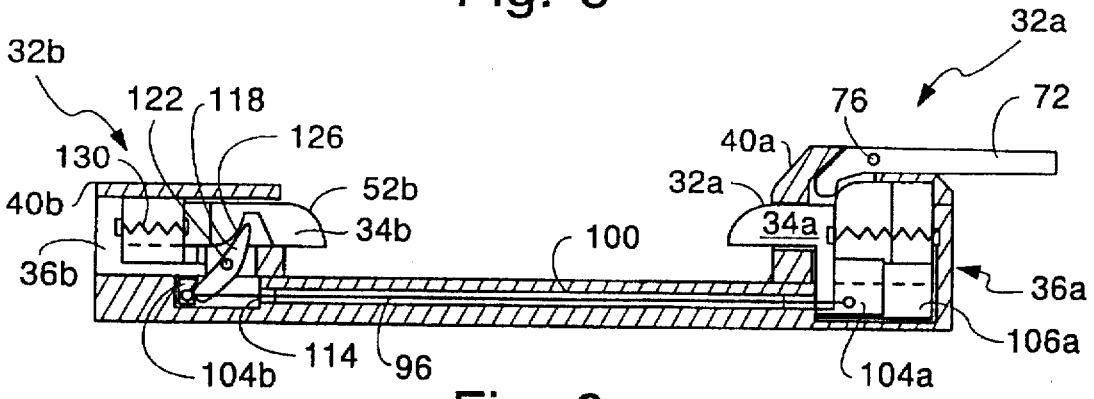
FIG. 9 is a cross section of the embodiment shown in FIG. 8. In particular, the cross section of side engaging mechanism **32*a* is through line 9*a* of FIG. 8 and the cross section of side engaging mechanism 32*b* is through line 9*b*** of FIG. 8.

In one particular embodiment, shown in FIGS. 8 and 9, the binding system 20 of the present invention is provided with opposed active engaging members **34*a*, 34*b* that interact with each lateral side of a snowboarder's boot 24 in a similar manner to engaging member 34. Thus, preferably, each engaging member 34*a*, 34*b* has an upper curved surface 52*a*, 52*b*, similar to top curved surface 52, such that upon downward pressure supplied by the weight of the snowboarder's boot 24, each engaging member 34*a*, 34*b* is forced into their respective housings 36*a*, 36*b*, allowing the snowboarder's boot to move vertically downward into contact with the upper surface of the snowboard 28 and/or the binding system 20, whereby the engaging members 34*a*, 34*b* are allowed to extend horizontally toward the boot 24 and into a locking, engaging position with receptacles 60 on both sides of a boot plate 56 (or, more generally, compatible connecting unit) on the boot sole. This particular embodiment avoids the necessity that a snowboarder angularly position his/her snowboard boot sole so as to hook one lateral edge under a static restraining member and then pivot the sole of their boot to operate an active engaging member on the opposing lateral side of their boot. It should be appreciated that the duo-sided active engaging binding described herein can utilize not only the horizontally engaging member arrangement described herein, but also other engaging-type mechanisms, such as those that rely upon a pivoting or rotational engagement mechanism between a snowboarder's boot sole and binding. The present inventor is the first to appreciate that two laterally opposed active engaging members facilitates far easier binding of a snowboarder's boot 24 to the surface of a snowboard. As discussed below, the duo-active side arrangement provides a safer design that allows for easier release of a snowboarder's boot 24** from the binding, for example, after a fall in deep snow. Release from the engaging sites provides for ready removal of a boot from a snowboard without requiring the need for any angular or slidable movement of the snowboarder's boot to disengage the boot from the binding system.

Still referring to the duo-active site binding embodiment of FIGS. 8 and 9, each separate engaging member **34*a*, 34*b* can be moveable from a first engaging position to a second disengaging position by a lever 72 operably connected to at least one of the opposed engaging members. The operation of individual engaging members 34*a*, 34*b* can be coordinated by operatively connecting the engaging members such that retraction of one engaging member by a lever 72, for example, also acts to retract the other opposing engaging member. To accomplish this coordinated retraction of opposed engaging members 34*a*, 34*b*, one end of a cable 96 is attached to each of the engaging members. Operation of the lever 72 to retract the engaging member 34*a* also acts to pull the cable 96 in a manner that retracts the opposing engaging member 34*b*. This can be accomplished, for example, by running the cable 96 through a curved channel 100 and looping through (or otherwise attaching) the ends of the cable to slidable guides 104*a*, 104*b* that slide horizontally in slots 106*a*, 106*b*, respectively. (As an aside, note that guide 104*a* may be integral with engaging member 34*a*.) Thus, to accomplish the desired retraction of the opposed engaging members 34*a*, 34*b*, upon activation of the lever 72, slidable guide 104*a* is urged (by counterclockwise pivoting of lever 72 acting upon engaging member 34*a*) toward the slot surface 110. This, in turn, causes slidable guide 104*b*, via cable 96, to move toward slot surface 114 and thereby urge lever 118 to pivot counter-clockwise about a pin 122. In pivoting, the lever 118 contacts curved surface 126 and thereby causes engaging member 34b to retract and simultaneously to compress spring 130. Alternatively, when finger pressure is not applied to lever 72, then spring 130 causes engaging member 34b to extend, which in turn causes lever 118 to urge slidable guidelines 104a, 104b back to the positions shown in FIG. 9. Note that due to the conventional configuration of securing plate 134 (e.g., the portion of the boot positioning plate 38 that attaches a binding to a snowboard) under the mid-sole of a snowboarder's boot, one embodiment of the present invention (FIG. 8) has cable 96 connecting the two opposed engaging members wherein the channel 100 in which the cable resides is substantially semi-circular around the securing plate 134**.

Figure 10:
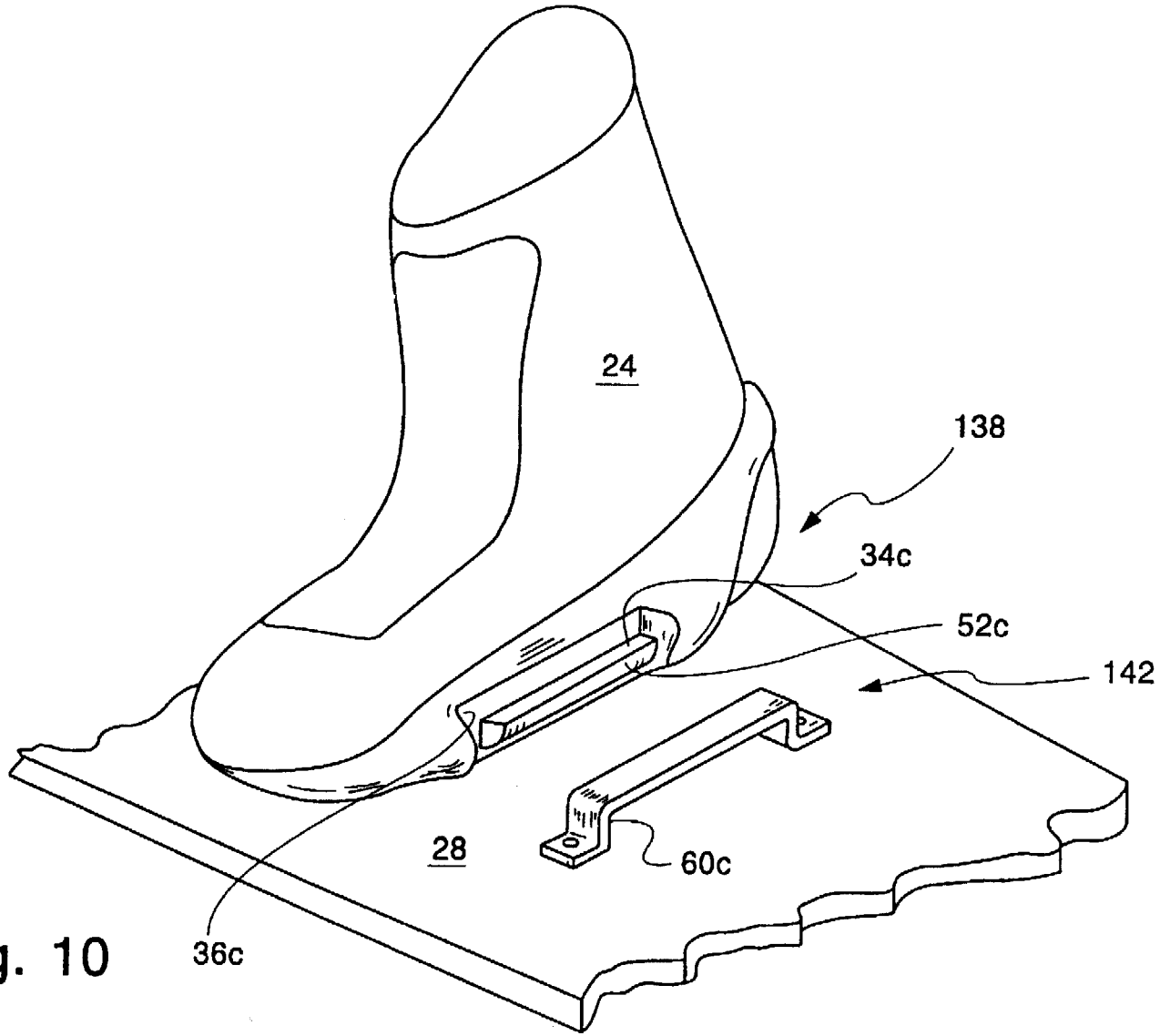
FIG. 10 shows an alternative embodiment of the present invention wherein the active engaging members **34*c* are fixably attached to the boot 24 rather than the snowboard 28**.
Figure 11:
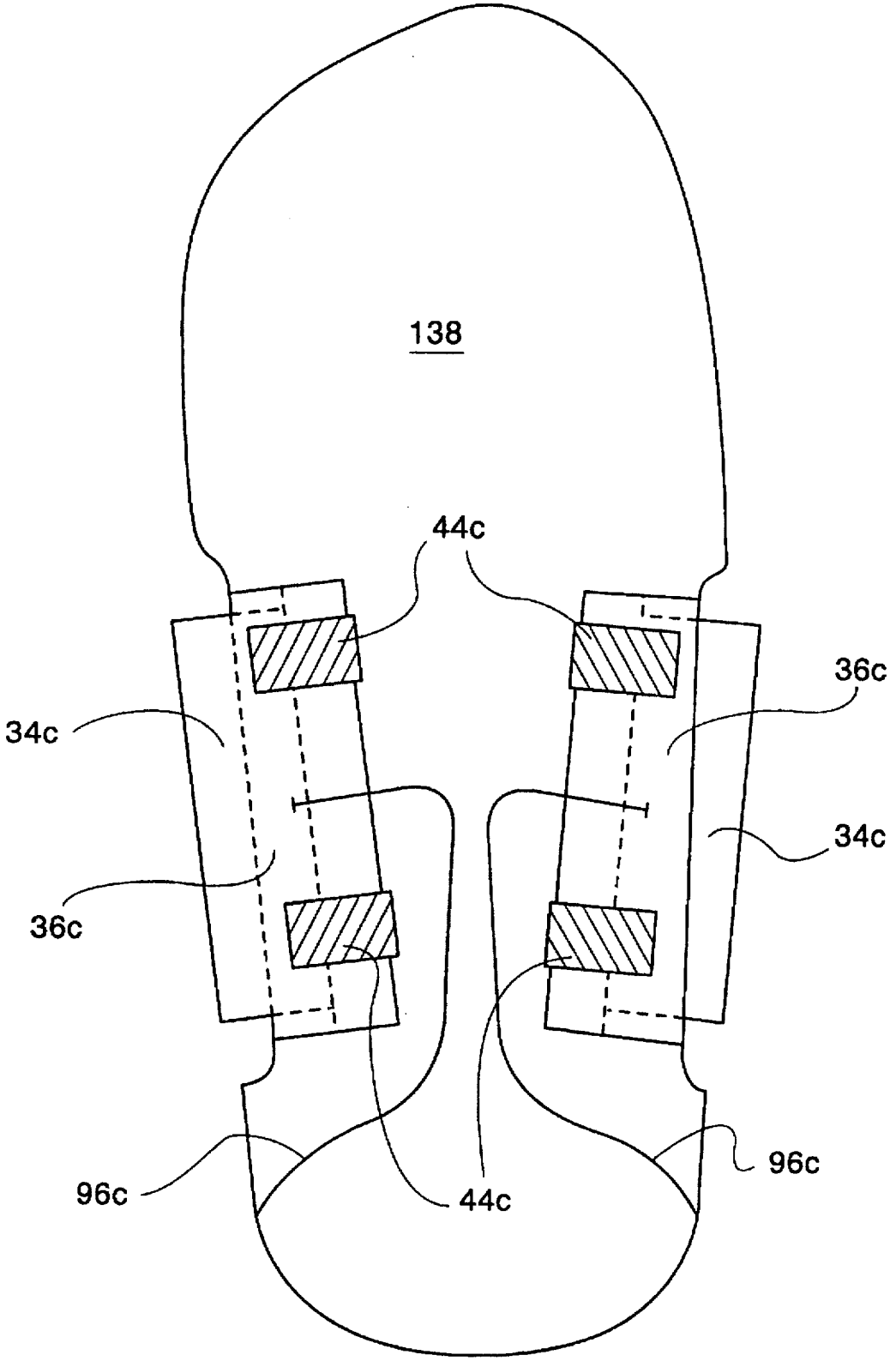
FIG. 11 shows a bottom view of the boot of FIG. 10 wherein the internal components related to the engaging members **34*c*** are illustrated.
Figure 12:
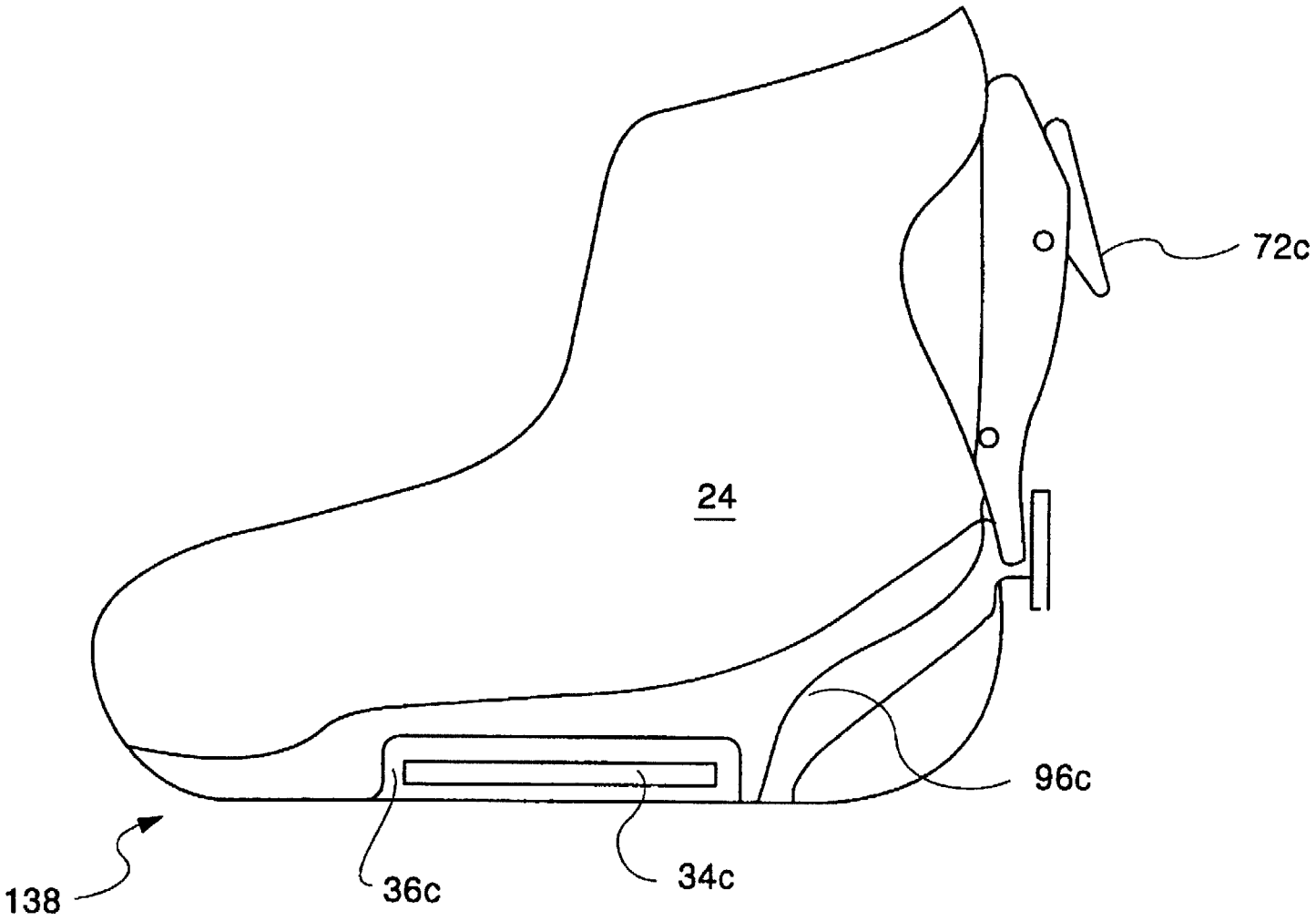
FIG. 12 is a side view of the boot 24 of FIG. 10.

In a separate embodiment of the present invention (FIGS. 10–12), at least one active engaging member 34c (FIG. 10) is integral with the snowboarder's boot sole 138, either by separately attaching such member to the sole of the boot, or by manufacturing the boot so that the sole has at least one active engaging member contained as a part of the sole. In such an embodiment, it is possible to have a static binding 142 attached to the snowboard 28 itself as shown in FIG. 10, thereby reducing the weight of the snowboard as compared to the weight of snowboards having bindings that have hardware components required to actively engage snowboard boots. Snowboard binding soles 138 (and/or retro-fittable snowboard binding plates fittable to snowboard boots) can be of various configurations, including the embodiments described above, although the respective positioning of static binding 142 (or receptacles 60c) and engaging members 34c are reversed between the boot sole and the snowboard 28. Furthermore, a snowboard boot having the binding system of the present invention integral with the boot sole can have one active site on one side of the boot (the site on the other side of the boot being static) or, alternatively, the boot sole can have two active sites on each lateral side of the boot, as shown in FIG. 11, wherein components of the boot sole 138 with comparable functionality to the components of the active snowboard binding system 20 of FIGS. 1–9 are labeled with identical numbers but followed with a "c." Also note that in a preferred embodiment, the shape of the engaging member 34c will be such that a curved portion 52c of the engaging member is reversed from the position of the curved member 52 so that the curved portion 52c is directed toward the surface of the snowboard 28.

In operation, a snowboarder using a duo-active site sole can simply step into a static snowboard binding (e.g., static binding 142) attached to a snowboard 28 and the downward force of the snowboarder's weight will cause the curved surface 52c of the engaging members 34c to interact with the upper edge of two opposed static bindings on the snowboard, thereby moving the engaging members 34c from a first extended position to a second retracted position. Further downward pressure will cause the engaging members to move back into said first extended position after passing downwardly to a point where the engaging members 34c can extend into the receptacles or openings 60c of the two opposed static bindings.

In the present embodiment, the pair of receptacles 60c into which the engaging members 34c extend are not much further apart than the width of the snowboarder's boot. In other embodiments, however, in particular where duo-active engaging mechanisms are laterally spaced and affixed to the snowboard 28 (as in FIGS. 8 and 9), different configurations of static and active engaging mechanisms can be utilized. For example, an extended bar-like structure can be fitted on each side of a snowboarder's boot sole to pivotally engage with two opposing active sites secured to the snowboard 28.

Further note that the present binding system also permits visual verification of positive engagement of a boot 28 with the binding system, unlike numerous binding systems available on the market that are difficult to determine whether a boot is adequately secured to a snowboard. Clear windows (plastic) can be placed in top 40 of the housing 36 (also in top of 40b) through which colored portions of engaging members 34a and 34b will be visible. For example, red would be visible when not fully engaged and green visible when fully engaged.

As with the invention embodiment having engaging members attached to the snowboard 28, the lever 72c which operates the reversible engagement of the engaging member (s) 34c, a locking mechanism (not shown) can also be provided so that unintentional disengagement of the engaging member(s) is precluded. Such a locking mechanism can comprise, for instance, a finger-slidable member, preferably retractably tensioned with a circular spring that contacts a housing adjacent the pivotable mount of the lever 72c, thereby preventing the lever from an upward movement which would act to disengage the engaging member from a boot receptacle 60c.

Note that, regardless of where the engaging member(s) are located, such embodiments may utilize an open frame housing construction so as to provide for easy removal of snow and ice that may interfere with the operation of the engaging member(s).

It is also within the scope of the present invention to utilize different types of active engaging members with a retro-fittable sole attachment and/or as an integral part of a snowboarder's boot sole. For example, pivotable binding structures such as those described in Raines, U.S. Pat. No. 4,973,073 or Glaser, U.S. Pat. No. 5,299,823, can be used instead of the horizontally moving engaging member 34c described herein. Although a snowboard boot sole preferably has such active bindings positioned on each lateral side, it is also within the scope of the present invention to have active binding mechanisms positioned at other lateral sole positions (e.g., such as at a heel or toe position) or any combination of toe, heel or side sites. By having active bindings formed integral with a snowboarder's boot, the weight of a snowboard is greatly reduced by eliminating the typically heavy binding mechanisms that are conventionally attached to the snowboard 28 itself. Snowboards can also merely be fitted with static structures that engage with active binding sites of a snowboarder's boot sole. Moreover, due to the preferred positioning of the active binding on the mid-side portions of a boot sole, normal walking action by a snowboarder is not impeded given that the mid-portion of a boot typically does not require flexibility. Side mounted bindings integral with a boot sole are preferably made of light-weight metal or hard plastic material and can also be retractable by movement of a lever 72c for positioning engaging members entirely within the confines of the boot sole perimeter or, alternately, allowing the engaging members to extend.

Yet another aspect of the present invention involves the proper contact of a snowboarder's sole with the surface of the snowboard 28. Given the lateral engaging mechanisms and/or the connecting units such as the retro-fittable binding plates 300 described herein, it may be necessary to provide elevated toe and heel structures to maintain the board feel for a snowboard rider. Therefore, to the extent that lateral side engaging bindings and/or connecting units, as set forth herein, require elevation of the snowboarder's sole above the surface of the snowboard, toe and heel projections can be positioned and affixed to the snowboard's upper surface so as to afford a relatively uniform horizontal plane for the boot sole once in locked engagement with the lateral engaging bindings.

The lateral engaging bindings of the present invention can also be adjustable about the conventionally circular securing plate 134 found on typical snowboard designs. For example, the binding system 20 embodiment of FIG. 2 includes securing slots 200 through which mounting bolts (not shown), used for mounting a snowboard binding to the snowboard, are received. However, since the securing slots are elongated, the binding system 20 may be adjusted along the longitudinal axis 204. Moreover, the pattern of the securing slots 200 may take other configurations such that, for example, the binding system 20 may be adjustably rotated about center point 208. Moreover, the present binding system can be formed from a continuous, solitary piece of material so that both lateral sides, whether active or not, as well as any toe and heel elevated portions, are combined as a single unit.

Figure 18:
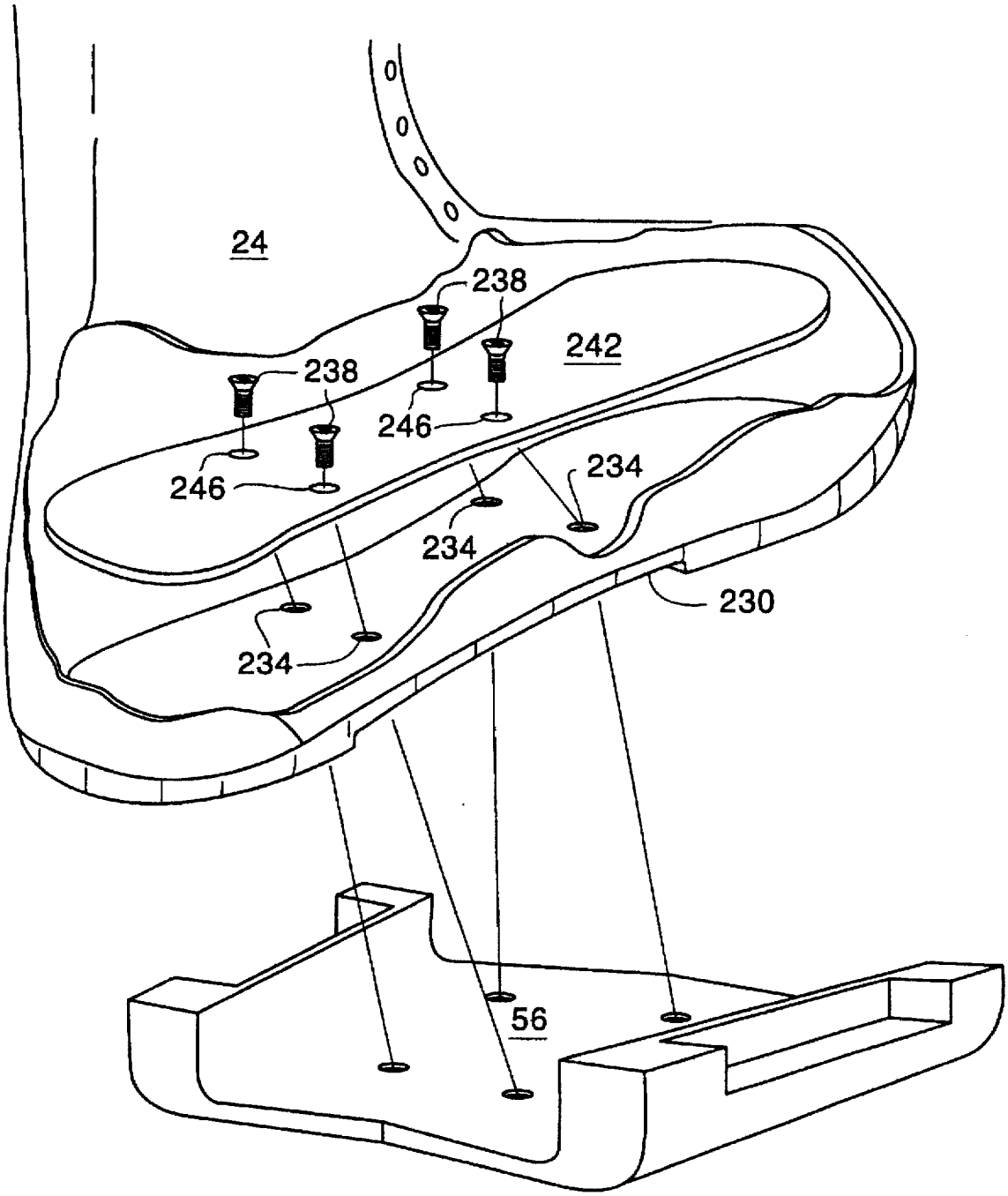
FIG. 18 shows one embodiment for attaching a connecting unit (e.g., boot plate 56) to a boot.

Connecting units can also be designed to be retro-fittable with various existing boot designs, thereby accommodating a snowboarder's boot preference. Desired stability and ruggedness is achieved by utilizing metal or hardened plastic for such plates. Attachment of such plates to the sole of a desired boot can be by screws, adhesives, etc. In one preferred embodiment shown in FIG. 18, an attachment is provided whereby a retro-fittable boot plate 56, for example, having static (or alternately active) lateral sides, as described above, is attached to a boot sole 230 by providing holes 234 in the sole through which screws or bolts 238 can pass. A metallic or hardened plastic sole member 242 is placed inside a snowboard boot 24, preferably below soft cushioning material used to protect a snowboarder's socked foot. The relatively rigid sole member 242 may have threaded apertures 246 to receive the screws/bolts, thereby providing a secure attachment site for the boot binding plate.

Figure 14:
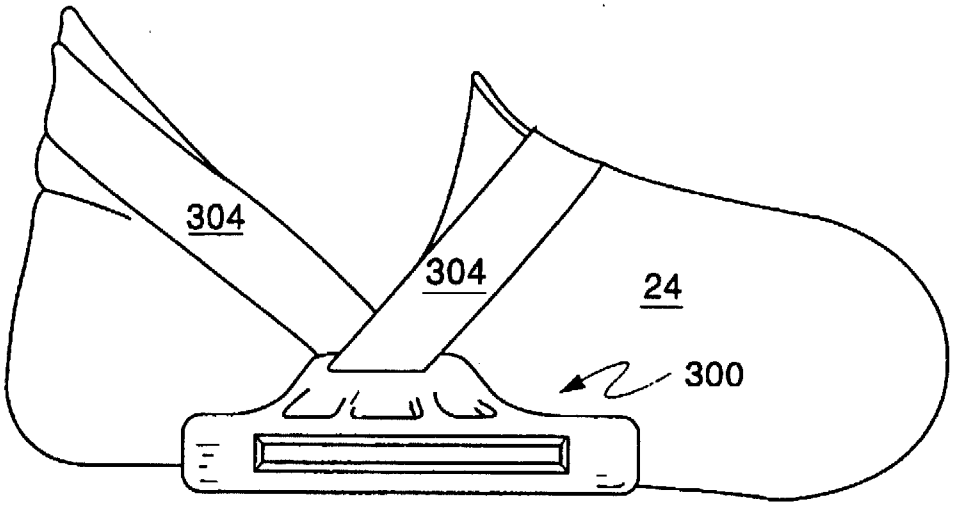
FIG. 14 shows a side view of the binding plate 300 attached to a boot 24.
Figure 13:
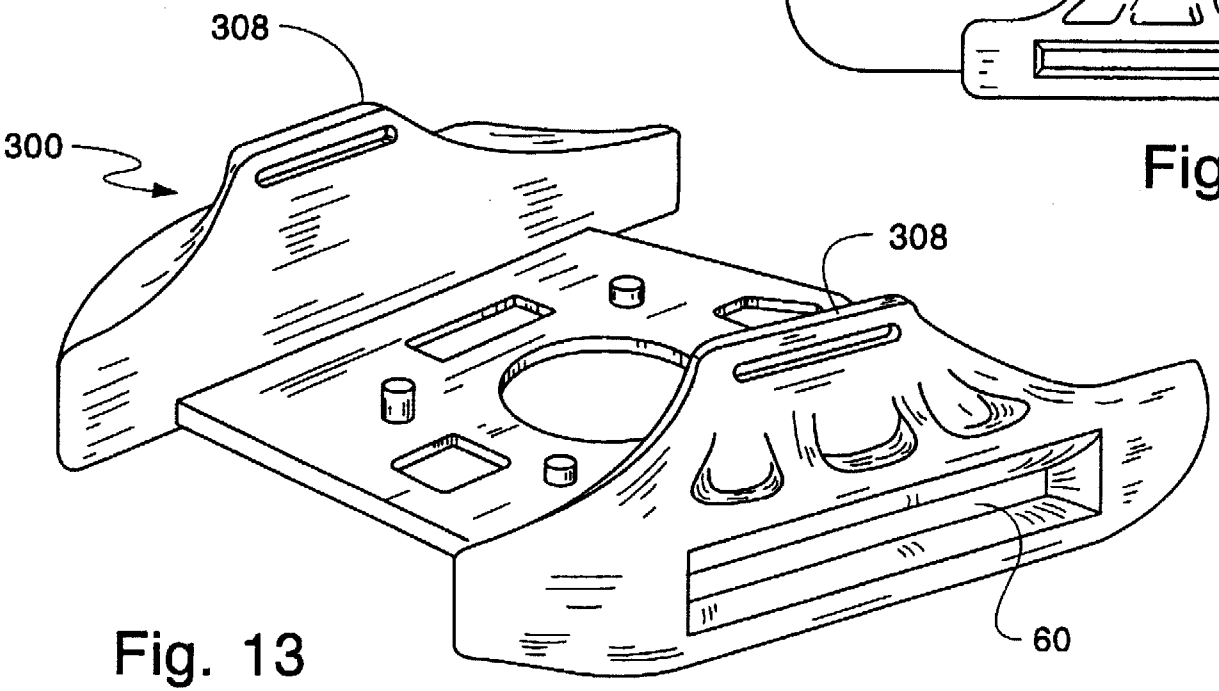
FIG. 13 shows a binding plate 300, retro-fittable to a conventional boot, wherein the binding plate locks into the binding system 20 on a snowboard. Thus, the binding plate 300 serves to attach the boot to the snowboard.

Alternatively, retro-fittable binding plates can be attachable to existing snowboard boots by means of adjustable straps. Thus, instead of having the connecting unit integral with the boot 24 as with the boot plate 56, the connecting unit may be separate from the boot, but retro-fittable to various boots. One such embodiment of a connecting unit is shown in FIGS. 13 and 14, that is, retro-fittable binding plate 300. This connecting unit, as can be seen in FIG. 14, attaches to the bottom of a boot 24 via, for example, velcro straps 304. As best shown in FIG. 13, the straps 304 lace through one or more strap holders 308 on each lateral side of the binding plate 300. Further, as with the boot plate 56, the binding plate 300 includes laterally positioned receptacles 60 for receiving the engaging members such as active engaging member 34.

Alternatively, boots can be manufactured having a connecting unit integrally molded into the sole, the connecting unit being made of hardened plastic, metal, or any other suitable material capable of withstanding the stresses encountered in snowboarding.

Figure 15:
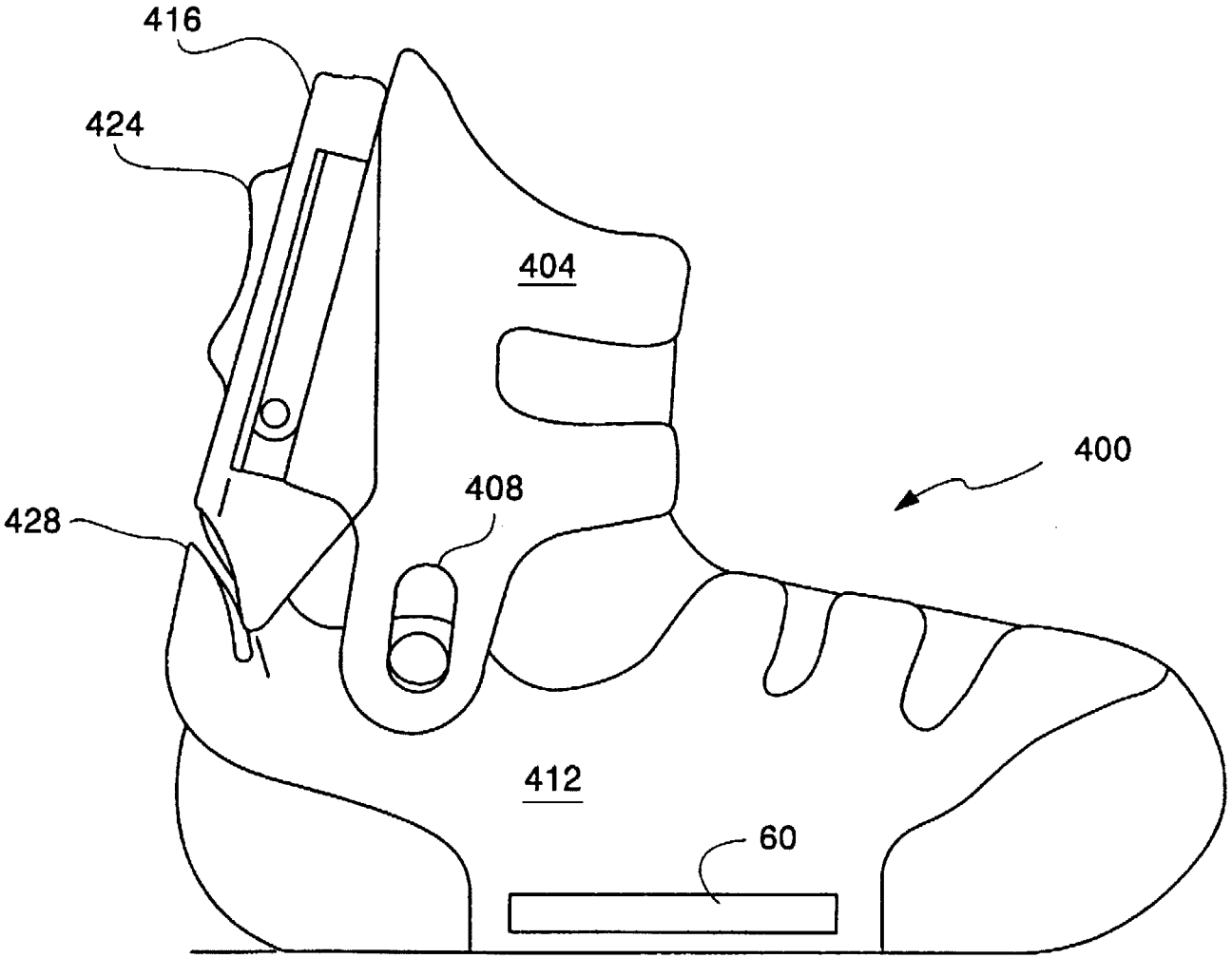
FIG. 15 shows a side view of a boot 400 suitable to be utilized with the binding system 20.
Figure 16:
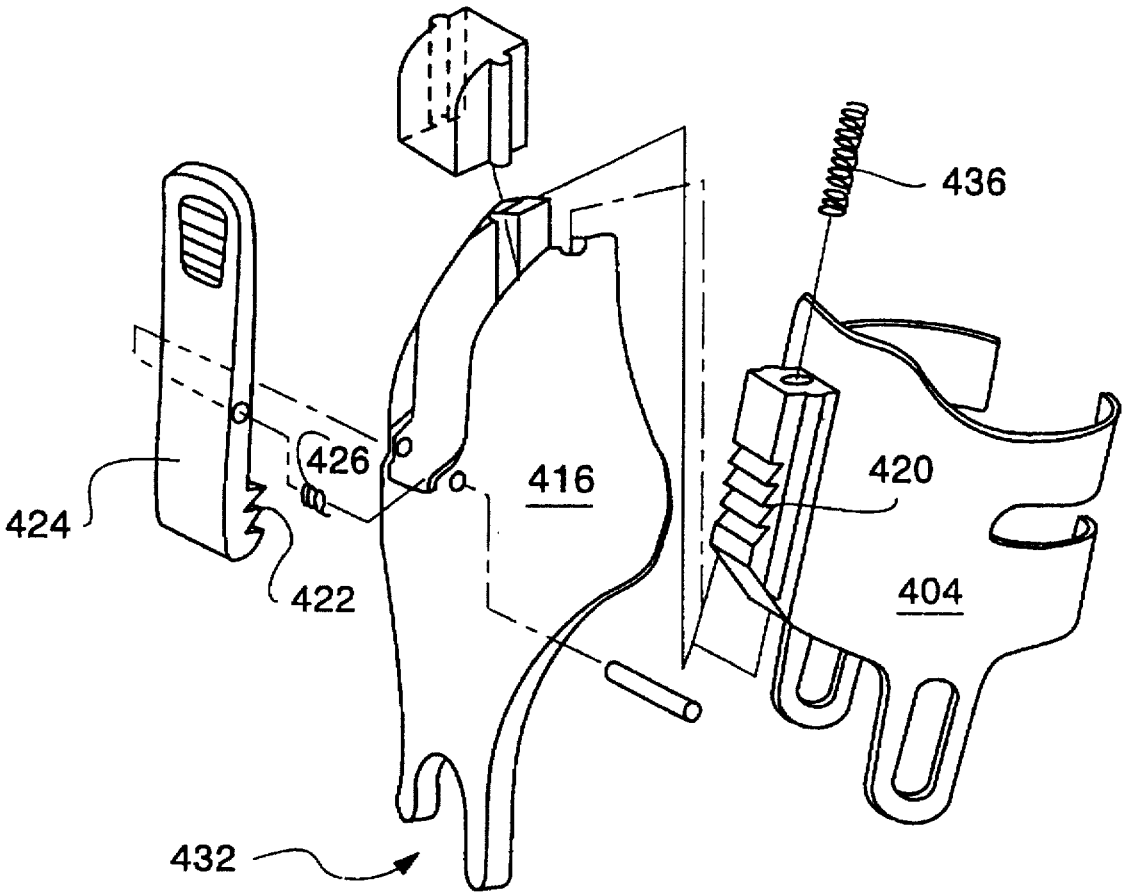
FIG. 16 shows a more detailed view of the high-back element 416.
Figure 17:
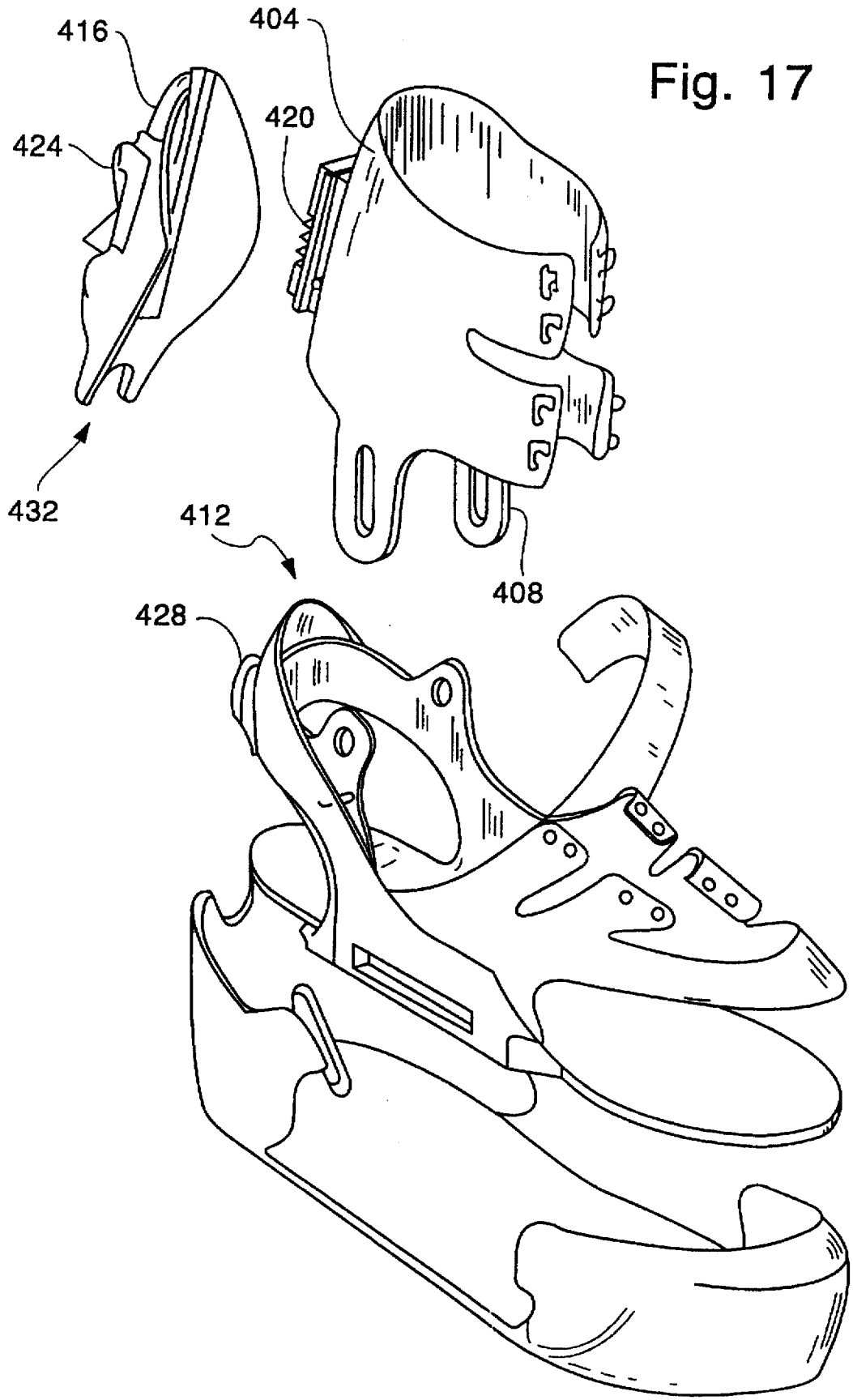
FIG. 17 shows an exploded view of the boot 400.

Yet another aspect of the present invention involves the design and operation of a snowboard boot suitable for use with binding system 20 to provide desired safety and performance characteristics. Referring to FIGS. 15–17, a snowboard boot 400 is disclosed. The boot 400 includes a stiffened upper calf member 404 adjustably attached, via adjustment slots 408, to a boot frame 412, thereby allowing both axial, rotational movement generally corresponding to the angular movement of a snowboarder's ankle (e.g., in a forward-to-backward direction) and adjustment to accommodate a desired calf support height. A substantially rigid high-back element 416 is vertically slidably engageable with adjustable, on the upper calf member 404 so that the high-back element 416 is vertically moveable by finger disengagement of adjustment latch 424 (more precisely, teeth 422) from teeth 420. Note that adjustment latch 424 is biased, by spring 426, so that teeth 422 and 420 engage. Further note that the lower portion of the high-back element 416 is releasably engageable with a corresponding nub 428 associated with the rearward portion of a boot frame 412. The lower portion of the high-back element 416 can have a fork-like configuration 432, whereby the fork engages the nub 428 on the boot frame so as to permit side-to-side rotation of the high-back element 416 in a direction substantially perpendicular to the natural forward-rearward angular movement of a rider's ankle. The high-back element 416 is slidably adjustable on the upper calf member 404, and the high-back element is disengageable from the nub 428 on the boot frame 412 so as to facilitate a more natural walking motion by a snowboarder when walking from place to place. Note that the spring 436 urges the high-back element 416 to slide up thereby making easy the disengaging of the high-back element with the nub 428. Further note that the boot 400 embodiment avoids the bulky "high-back" members that enclose and restrict a snowboarder's foot, ankle and (some portion of) calf, utilized on various conventional snowboard bindings. In particular, conventional high-back members are part of the binding itself, adding bulk to the snowboard/binding combination and acting to restrict easy movement of the snowboarder's ankle, thus preventing desired lateral motion between a snowboarder's calf and lower foot.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A snowboard binding system, comprising:

a boot engaging plate having means for attaching said plate to a snowboard, said engaging plate having at least two laterally moveable engaging members, said engaging members being engageable to engagement receptacles located along lateral sides of a boot in a manner to secure said boot from moving in a vertical or horizontal position once said engaging members are engaged, said engaging members being moveable between a first engaging position and a second disengaging position, means for biasing said engaging members to said first engaging position, whereby vertical pressure caused by downward movement of said boot towards said engaging plate is sufficient to move said engaging members from said first position to said second position and back to said first position, thereby securing said boot to said engaging plate, and a release control member operably associated with at least one of said engaging members, said release control member being moveable between first and second positions, said first position being operable to permit said engaging members to move to said first engaging position and said second position being operable to move at least one of said engaging members to said second disengaging position for permitting said boot to be removed from said engaging plate.

2. The snowboard binding system as set forth in claim 1, wherein said engaging plate has a surface that accommodates snow and ice build up without preventing engagement of said boot with said base plate.

3. The snowboard binding system as set forth in claim 1, wherein said engaging member is under tension such that said engaging member is urged to be in said first engaging position.

4. The snowboard binding system as set forth in claim 1, further comprising a boot plate attachable to a boot, said boot plate having first and second sides, wherein at least one of said first and second sides has a receptacle for receiving said engaging member such that when said engaging member is in said first position, said engaging member interacts with at least one of said first and second receptacles, thereby securing said boot plate in a manner that prevents vertical or horizontal movement of said boot plate.

5. The snowboard binding system as set forth in claim 1, wherein said boot engaging plate does not provide for any toe or heel attachments.

6. The snowboard binding system as set forth in claim 1, wherein said engaging plate does not allow horizontally-slidable engagement between said boot and said binding when secured together.

7. The snowboard binding system as set forth in claim 1, wherein the downward pressure supplied by a snowboarder's weight is sufficient to move said engaging member from said first engaging position to said second position.

8. The snowboard binding system as set forth in claim 1, wherein said first and second engaging members are operably moveable by an elongated member that extends under the sole of a snowboarder's boot, said elongated member capable of transmitting force exerted by a lever operatively engaged with at least one of said first and second engaging members, said force sufficient to move said first and second engaging members into said second disengaging position.

9. The snowboard binding system of claim 1, further comprising static elements to prevent horizontal movement of a rider's boot in said binding.

10. The snowboard binding system as set forth in claim 1, further comprising a boot plate having a protruding member that, when brought into engagement with said engaging member, forces said engaging member into said housing.

11. The snowboard binding system as set forth in claim 10, wherein said protruding member has an irregular surface to facilitate dissipation of snow and ice when said engaging member is moved into engaging position.

12. The snowboard binding system as set forth in claim 10, wherein said protruding member is positioned under said engaging member when said engaging member is in said first position.

13. The snowboard binding system as set forth in claim 1, further comprising a means for positive engagement verification which indicates if a boot is adequately secured to said binding.

14. A binding assembly to hold a boot in an operational position on the surface of a snowboard, comprising:

a boot plate attached to a sole of a snowboard boot, said boot plate having two locking recesses, each said locking recess substantially adjacent to an opposite side of the boot;

attachment housing means operationally fixed to said snowboard for releasably binding to said boot plate so that the boot and the snowboard are in a first mode fixedly bound together during operation and in a second mode detached from one another, wherein said attachment housing means includes a bottom plate attached to said surface of said snowboard and opposing spaced apart boot plate retaining members attached to said bottom plate and projecting away from said surface of said snowboard, said boot retaining members each having at least one laterally movable tongue biased in a direction for mating with said locking recesses for fixedly attaching said boot to said attachment housing means, and a release control memeber for urging said at least one tongue away from said locking recesses for permitting the boot to be disengaged from the snowboard;

wherein at least one of said tongues is moveable in a planar direction substantially parallel to the snowboard surface so that a snowboarder's weight applied to mating said locking recesses with said tongues, when said boot is moved downwardly towards said bottom plate, is sufficient for binding said boot to said snowboard.

15. An apparatus as claimed in claim 14, wherein said at least one tongue is moveable within one of said retaining members.

16. An apparatus as claimed in claim 14, wherein said at least one tongue is urged to a mating with one of said locking recesses by a spring means.

17. A binding assembly to hold a boot in an operational position on the surface of a snowboard, comprising:

a boot plate attached to a sole of a snowboard boot, said boot plate having two locking recesses, each said locking recess substantially adjacent to an opposite side of the boot;

attachment housing means operationally fixed to said snowboard for releasably binding to said boot plate so that the boot and the snowboard are in a first mode fixedly bound together during operation and in a second mode detached from one another, wherein said attachment housing means includes a bottom plate attached to said surface of said snowboard and opposing spaced apart boot plate retaining members attached to said bottom plate and projecting away from said surface of said snowboard, each of said boot retaining members having a laterally moveable tongue biased in a direction for mating with said locking recesses, said attachment housing means including a manually manipulatable retraction means for urging at least one of said moveable tongues away from said locking recesses so that the boot disengages from the snowboard;

wherein at least one of said tongues is movable in a planar direction substantially parallel to the snowboard surface so that a snowboarder's weight is sufficient to mate said locking recesses with said tongues, when said boot is moved downwardly towards said bottom plate, for binding said boot to said snowboard.

18. An apparatus as claimed in claim 17, wherein said at least one tongue is urged to a mating with one of said locking recesses by a spring means positioned under said boot sole.

19. The apparatus as claimed in claim 18, further comprising a spring operatively associated with said engaging members, said spring having a first extended and a second compressed position, said spring being in said first position when said boot is engaged with said binding.

* * * * *